US007137177B2

(12) United States Patent
Fujii et al.

(10) Patent No.: US 7,137,177 B2
(45) Date of Patent: Nov. 21, 2006

(54) TOP END STOP OF LINEAR SLIDE FASTENER

(75) Inventors: Osamu Fujii, Toyama-ken (JP); Minoru Uno, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/966,324

(22) Filed: Oct. 14, 2004

(65) Prior Publication Data

US 2005/0081340 A1 Apr. 21, 2005

(30) Foreign Application Priority Data

Oct. 17, 2003 (JP) ..... 2003-357949

(51) Int. Cl.
*A44B 19/36* (2006.01)

(52) U.S. Cl. ..... 24/433; 24/389; 24/382; 24/436; 24/392; 24/391

(58) Field of Classification Search ..... 24/398, 24/391, 392, 433, 434, 436
See application file for complete search history.

(56) References Cited

U.S. PATENT DOCUMENTS 3,928,098 A * 12/1975 Moertel ..... 156/73.4
3,972,095 A 8/1976 Kandou
5,359,754 A * 11/1994 Kondo et al. ..... 24/436
6,427,295 B1 * 8/2002 Matsumoto et al. ..... 24/403

FOREIGN PATENT DOCUMENTS

| | | |
|---|---|---|
| GB | 1000597 | 8/1965 |
| JP | 46-1148 | 1/1971 |
| WO | WO 2004/000062 | 12/2003 |

* cited by examiner

*Primary Examiner*—Katherine Mitchell
*Assistant Examiner*—Marcus Menezes
(74) *Attorney, Agent, or Firm*—Everest Intellectual Property Law Group; Michael S. Leonard

(57) ABSTRACT

Coil-like or zigzag-like linear fastener elements formed of synthetic fiber mono-filaments are attached such that coupling heads project from a side edge of a fastener tape and at least one coupling head thereof located at a top end is moved to the inside of the fastener tape so as to substantially coincide with the side edge. Then, the fastener element is fused to the fastener tape in a state in which an inverted portion project inwardly while the coupling heads are in a non-coupling condition, so as to form a top end stop. The top end stop formed of the linear fastener element includes plasticity and provides an excellent tactile feeling without any burr on the surface thereof.

9 Claims, 8 Drawing Sheets

TOP END STOP OF LINEAR SLIDE FASTENER

BACKGROUND OF THE INVENTION

1. Field of the Invention

The present invention relates to a top end stop of a linear slide fastener in which linear fastener element row formed of synthetic fiber mono-filaments are mounted on side edges of a fastener tape, the top end stop being formed at a top end portion of the fastener tape by processing the linear fastener elements.

2. Description of the Related Art

According to Japanese Utility Model Publication No. 46-1148, in a linear slide fastener in which linear fastener element row formed from synthetic fiber mono-filaments are sewed on a side edge of a fastener tape or a bent side edge of a fastener tape bent into the form of a letter U, as shown in FIG. 10, an appropriate number of the linear fastener elements 105 located on the top end portion of the slide fastener 112 are fused by ultrasonic processing means or high frequency processing means under a pressure. Consequently, the fastener tape 112, the core thread 116, the sewing thread and the like are fused together integrally and expanded widely to both sides with respect to the coupling heads 119 and inverted portions 120 of connected other fastener elements so as to form a top end stop 101 of the linear slide fastener.

Because in the top end stop 101 of the linear slide fastener shown in FIG. 10 described above, a few linear fastener elements 105 located at the top end portion of the slide fastener are fused by ultrasonic processing or high frequency processing under a pressure, so that the fastener tape 112, the core thread 116, the sewing thread and the like are fused together integrally. Therefore, burrs are likely to occur on the surface of the top end stop and the top end stop itself is rigid providing a bad feeling to the skin. For example, when this is used at an overlapping section of clothes such as shirts and jackets, the top end stop makes contact with the neck, providing a feeling of discomfort. Further, there is a fear that such linear fastener elements may be difficult to sew on clothes or the like.

The present invention has been accomplished in views of the above-described problems and a primary object of the present invention is to provide a normal type or hidden type linear slide fastener which has a plasticity without becoming rigid and is free of any burr on its surface, thereby ensuring an excellent tactile feeling, this top end stop being capable of being produced at a low cost with simple manufacturing means.

In addition to the above-mentioned object, another object of the present invention is to provide a top end stop of a normal type or hidden type linear slide fastener in which right and left coupling heads in the top end stop formed by fusing the linear fastener elements with the fastener tape are in a non-coupling condition while end faces of the inverted portions make contact with an inside wall face of a flange in a slider so as to stop the slider from sliding.

Still another object of the present invention is to provide a top end stop of a normal type or hidden type linear slide fastener in which right and left coupling heads in the top end stop formed by fusing the linear fastener elements with the fastener tape are in a non-coupling condition while the inverted portions make contact with the front end of a flange of a slider so as to stop the slider from sliding.

Yet still another object of the present invention is to provide a top end stop of a normal type linear slide fastener in which coil-like fastener elements or zigzag-like fastener elements are employed as the fastener elements in a normal type slide fastener, the top end stop being produced easily with this fastener element.

A further object of the present invention is to provide a top end stop of a hidden type linear slide fastener in which coil-like fastener elements are used as the fastener elements in the hidden type slide fastener, the top end stop being produced easily with this fastener element.

A still further object of the present invention is to provide a top end stop of a good quality normal type or hidden type linear slide fastener in which, when the top end stop is manufactured with the linear fastener elements, a core thread is passed through coil-like fastener elements or zigzag-like fastener elements, thereby preventing the linear fastener elements from escaping from the sewing threads at the time of processing.

A still further object of the present invention is to provide a top end stop of a linear slide fastener which is formed using the linear fastener elements and can be fixed easily and securely on a fastener tape in case of both the normal type and hidden type linear slide fasteners, the top end stop being formed strictly and stably.

A still further object of the present invention is to provide a top end stop of a linear slide fastener which is manufactured using upper and lower leg portions projecting to the side of the sewing threads in the coil-like fastener elements or the zigzag-like fastener elements, the top end stop being formed with a high strength.

SUMMARY OF THE INVENTION

To achieve the above objects, as the main feature of the invention, the invention provides a top end stop of a linear slide fastener, being characterized in that a linear fastener element row is attached to a side edge of a fastener tape or a bent side edge bent in parallel along the side edge, the linear fastener element row comprises plural linear fastener elements, at least one linear fastener element of the linear fastener elements at a top end portion of the linear fastener element row is moved to an inside of the fastener tape more inwardly compared to a position of the other linear fastener elements, and the moved linear fastener element and the fastener tape are fused together and fixed so as to form the top end stop.

Further preferably, the linear fastener elements comprise a coupling head and an inverted portion connecting adjacent linear fastener elements each other, the inverted portion of the moved linear fastener element is projected to the inside of the fastener tape more inwardly compared to a position of the inverted portions of the other linear fastener elements.

Under the above-described configurations, at least one linear fastener element of the linear fastener elements at a top end portion of the linear fastener element row attached to the side edge of the fastener tape is moved to an inside of the fastener tape more inwardly compared to a position of the other linear fastener elements without addition of any other material, and the fastener elements and the fastener tape are fused together so as to produce a top end stop. Consequently, this produced top end stop has a plastic surface and ensures an excellent quality without any burr, and further can be produced at a low cost with simple means.

Preferably, the linear fastener element which is moved, fused together and fixed on the fastener tape makes contact with a slider so as to stop the slider.

Further preferably, the linear fastener element fused together and fixed on the fastener tape has a stop mechanism in which while the right and left coupling heads oppose each other in a non-coupling condition, an inverted portion makes contact with an inside wall face of a flange of the slider.

Due to the provision of such a stop mechanism, the inverted portions on the opposite side to the coupling heads of the right and left fastener elements retreat further to the inside of the fastener tape and project so that they make contact with the inside face of the flange, thereby stopping the slider from sliding. Consequently, with such a simple structure, the slider can be stopped with a smart appearance.

Further preferably, the linear fastener element at a portion where the linear fastener element and the fastener tape are fused together and fixed has a stop mechanism in which while the right and left coupling heads oppose each other in a non-coupling condition, an inverted portion makes contact with a front end portion of a flange.

Due to the provision of the stop mechanism in which the right and left coupling heads oppose each other in the non-coupling condition while the inverted portions make contact with the front end portions of the flange, the coupling heads of the right and left fastener elements oppose in the non-coupling condition, and the inverted portions on the opposite side to the coupling head retreat to the inside of the fastener tape and project so that they make contact with the front end of the flange, thereby stopping the slider from sliding. Thus, the slider can be stopped easily and securely with such a simple structure.

Preferably, coil-like fastener elements are used as the linear fastener elements, and the coil-like fastener elements are attached to a surface of the side edge of the fastener tape.

As a result, the top end stop can be manufactured easily on the normal type coil-like slide fastener.

Further preferably, zigzag-like fastener elements are used as the linear fastener elements, and the zigzag-like fastener elements are attached to a surface of the side edge of the fastener tape.

As a result, the top end stop can be manufactured easily on the normal type zigzag-like slide fastener.

Preferably, coil-like fastener elements are used as the linear fastener elements, and the coil-like fastener elements are sewed on the bent side edge of the fastener tape bent into a form of a letter U along the side edge.

As a result, the top end stop can be manufactured easily on the hidden type coil-like slide fastener.

Preferably, a core thread is passed through the linear fastener elements and the fastener elements are sewed onto the fastener tape.

According to this example, the fastener elements can be prevented from slipping out of the element sewing threads securely at the time of processing, so that the top end stop can exert its stop function securely.

Preferably, vicinity of a coupling head of the linear fastener element and the fastener tape are fused together and fixed through a contact portion.

According to this example, the coupling head can be fixed to the fastener tape firmly and the top end stop can be formed easily and securely.

Preferably, upper and lower leg portions on a side of an inverted portion of the linear fastener element are fused and fixed each other.

According to this example, the top end stop of the fastener elements can be formed with a high strength easily.

Preferably, the linear fastener elements comprise the coupling head projecting from the side edge or the bent side edge, and a front end of the coupling head of the moved linear fastener element substantially coincides with the side edge or the bent side edge. The substantial coinciding mentioned here refers to not only a state of complete coincidence but also a state in which the coupling head projects more or less from the side edge or the bent side edge or retreats slightly, so that consequently the coupling heads cannot couple.

Further preferably, plural linear fastener elements at the top end portion of the linear fastener element row are moved to the inside of the fastener tape.

Consequently, this produced top end stop has a plastic surface and ensures an excellent quality without any burr, and further can be produced at a low cost with simple means. The effects which the present invention exert are remarkably high.

DESCRIPTION OF THE PREFERRED EMBODIMENTS

Figure 1:
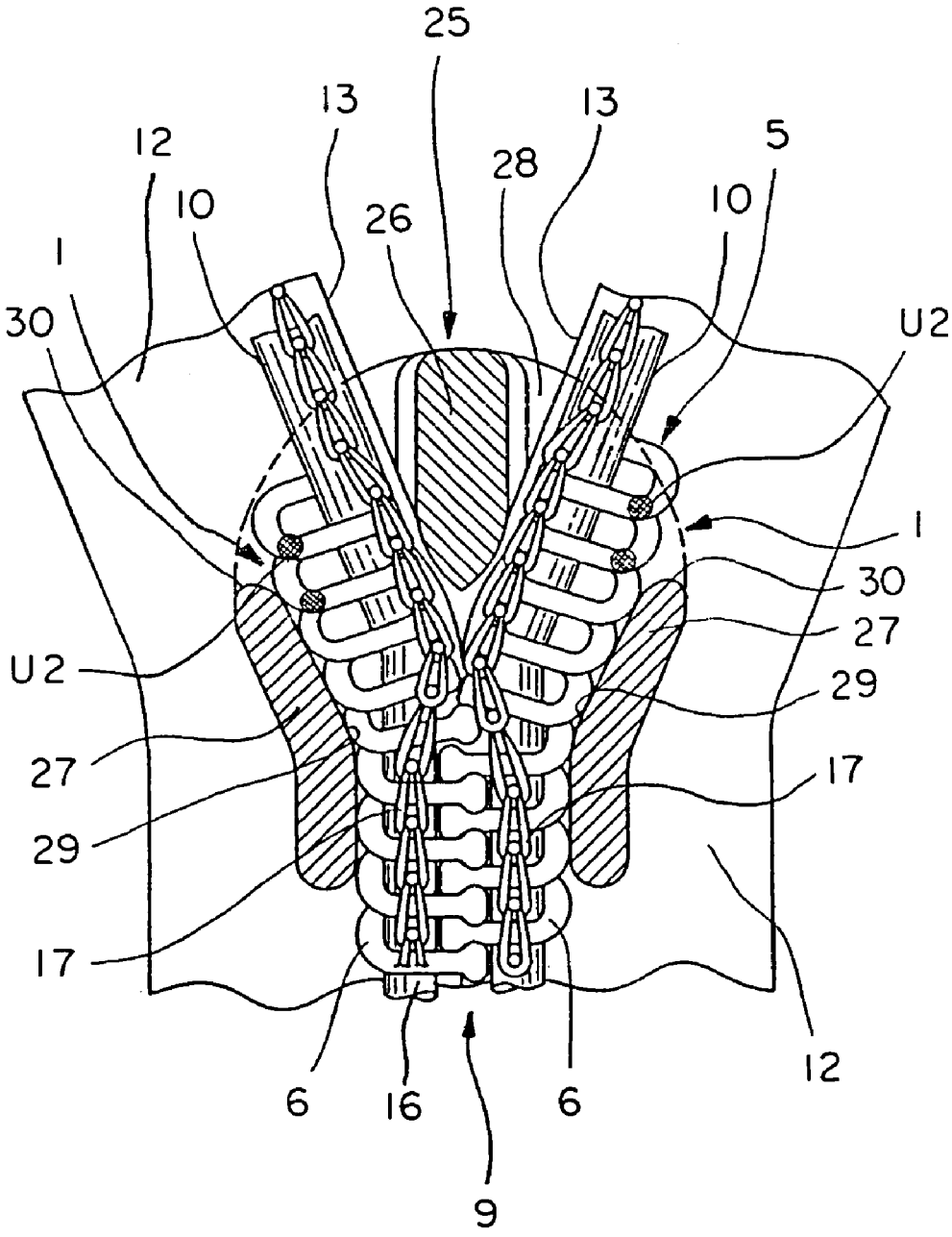
FIG. 1 is a sectional view showing major portions of a normal type linear slide fastener using coil-like fastener elements.

For a top end stop of a linear slide fastener of the present invention, mono-filaments of synthetic fiber such as polyamide and polyester is formed in a coil-like or zigzag form so as to form linear fastener element row comprising plural linear fastener elements 5, and the linear fastener elements 5 are sewed on the surface on a side edge 13 of a fastener tape 12 so as to form an endless fastener chain 9. A space portion 10 is produced by removing the linear fastener elements 5 at an interval corresponding to a predetermined length of the slide fastener in this fastener chain 9, and the bottom end stop or an opening device is installed at an end of this space portion 10 while the top end stop 1 is installed to the other end thereof. Then, the endless fastener chain is cut off at the space portion 10 so as to complete a normal type slide fastener.

Alternatively, the linear fastener elements 5 are sewed on a bent side edge 14 of the fastener tape 12 bent into the form of letter U so as to form the endless fastener chain 9. By removing the linear fastener elements 5 of a predetermined interval, the space portion 10 is formed in this fastener chain 9 and the bottom end stop and top end stop 1 are installed in the space portions 10. Then, the fastener chain is cut off at the space portion 10 so as to complete a hidden type slide fastener.

The plural linear fastener elements 5 adjacent to the space portion 10 are moved to the inside of the fastener tape 12 from the side edge 13 or the bent side edge 14 of the fastener tape 12 such that they retreat with respect to a sewing thread 17. Then, in that retreated condition, the vicinity of the coupling head 19, for example, its lower side, which makes contact with the fastener tape 12, is fused $U_1$ by ultrasonic processing and fixed so as to form the top end stop 1. The coupling head 19 at the top end portion of the coil-like or zigzag-like linear fastener elements 5 and an inverted portion 20, which is located to the opposite side of the coupling head 19 or inside of the fastener tape 12 and connected to the coupling head 19 through a leg portion 21 are moved to the inside of the fastener tape 12 more inwardly compared to the position of other coupling heads 19 and inverted portions 20. Therefore, this top end stop makes contact with an inside wall face 29 of a flange 27 in a mounted slider 25 or a front end portion 30 of the flange 27, thereby stopping the sliding of the slider 25 securely.

First Embodiment

Coil-like fastener elements 6 are produced by winding synthetic fiber mono-filament in the form of a coil as the linear fastener elements 5 for the linear slide fastener, or alternatively, the mono-filament is bent in a zigzag form so as to form zigzag-like fastener elements 7.

Figure 2:
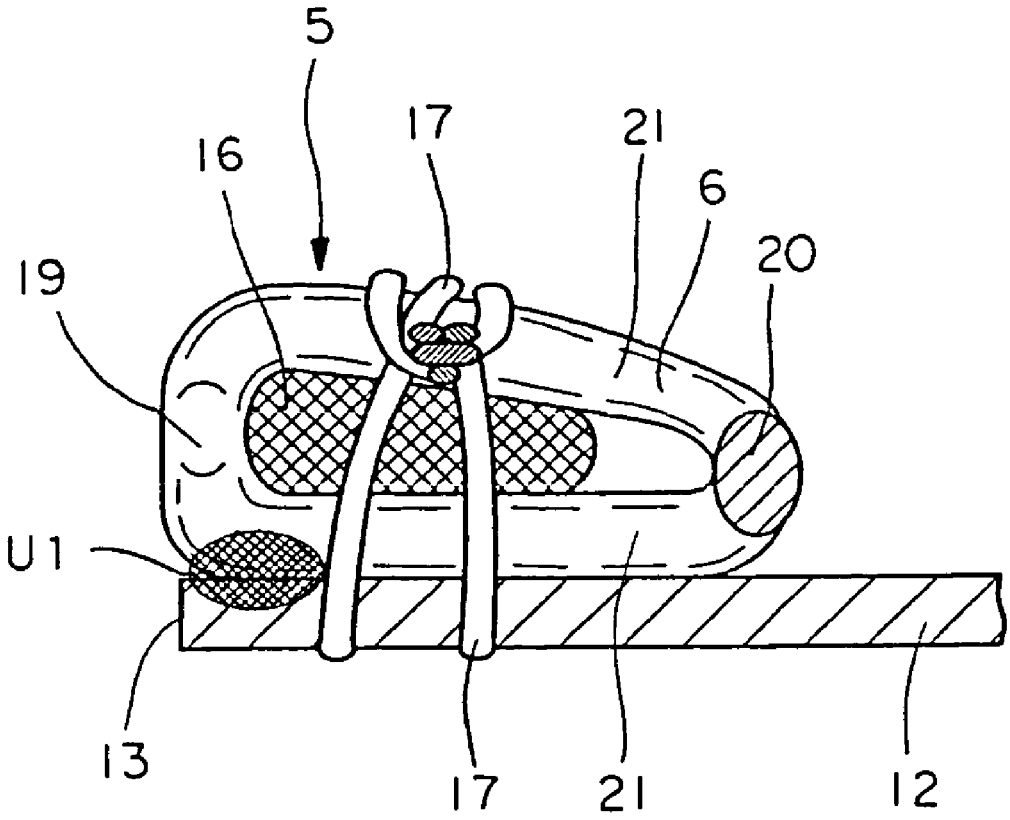
FIG. 2 is a sectional view of a top end stop of the same linear slide fastener.

As for the top end stop of the linear slide fastener according to the first embodiment of the invention shown in FIGS. 1 and 2, the coil-like fastener elements 6 are used as the linear fastener elements 5, and when the coil-like fastener elements 6 are sewed on the surface of the fastener tape 12 along the side edge 13 with the sewing thread 17, a core thread 16 is passed through the inside of the coil-like fastener elements 6 and this fastener tape is sewed over the core thread 16 with the sewing thread 17 such that the coupling heads 19 thereof project from the side edge 13 of the fastener tape 12 so as to produce an endless fastener chain 9.

The space portion 10 is produced at a predetermined interval of this fastener chain 9 or at every unit length of the slide fastener. By cutting upper and lower leg portions 21 on the side of the inverted portion 20 in the coil-like fastener element 6, the coupling head 19 is pulled out from the core thread 16 and the sewing thread 17 so as to produce the space portion 10. Then, the bottom end stop is created at one end of the formed space portion 10 while the top end stop 1 is created at the other end thereof, and thereafter, the fastener chain 9 is cut out at the space portion 10 so as to produce a normal type slide fastener.

By moving the coil-like fastener elements 6 adjacent to the space portion 10 formed in the fastener chain 9 to the inside of the fastener tape 12 from the side edge 13 of the fastener tape 12 such that the coupling head 19 retreats, the coupling head 19 is made to substantially coincide with the side edge 13. Then, the vicinity of the coupling head 19 of the coil-like fastener element 6, for example, the lower side thereof, which makes contact with the fastener tape 12, is fused $U_1$ by ultrasonic processing in conditions in which the inverted portion 20 of the coil-like fastener elements 6 retreats from the core thread 16 and the sewing thread 17 and then, the coil-like fastener elements 6 are fixed to the fastener tape 12. Because the inverted portions 20 of the fixed coil-like fastener elements 6 project to the inside of the fastener tape 12 more inwardly compared to the other inverted portions 20 of the coil-like fastener elements 6, this portion functions as the top end stop 1.

When the slider 25 mounted on the fastener chain 9 slides toward the top end of the coil-like fastener elements 6 in order to make engagement of the coil-like fastener elements 6 with each other, as shown in FIG. 1, this top end stop 1 invades into the inside of the element passage 28 formed inside the slider 25 through the shoulder side of the slider 25. At this time, the coupling heads 19 at the top end stop 1 just oppose each other without coupling, and the inverted portions 20 at the top end stop 1 come into contact with the inside wall faces 29 of the flange 27 provided on both sides of the element passage 28 protrudedly. Consequently, the top end stop 1 cannot move toward a rear mouth side of the slider 25 through the element passage 28, thereby stopping the sliding of the slider 25 easily. Further, by fusing $U_2$ together the overlapping upper and lower leg portions 21 on the side of the inverted portion 20 projected to the inside of the fastener tape 12 with loose spaces by ultrasonic processing, the top end stop 1 can be formed firmly. Depending on the configuration of the slider 25, the top end stop 1 comes into contact with the front end portion 30 of the flange 27, thereby stopping the sliding of the slider 25 easily. Although the coil-like fastener elements 6 can be sewed only with the sewing thread 17 without making the core thread 16 pass through the inside of the coil-like fastener elements 6, when moving in the coil-like fastener elements 6, it is necessary to block them from escaping from the sewing thread 17.

Second Embodiment

Figure 3:
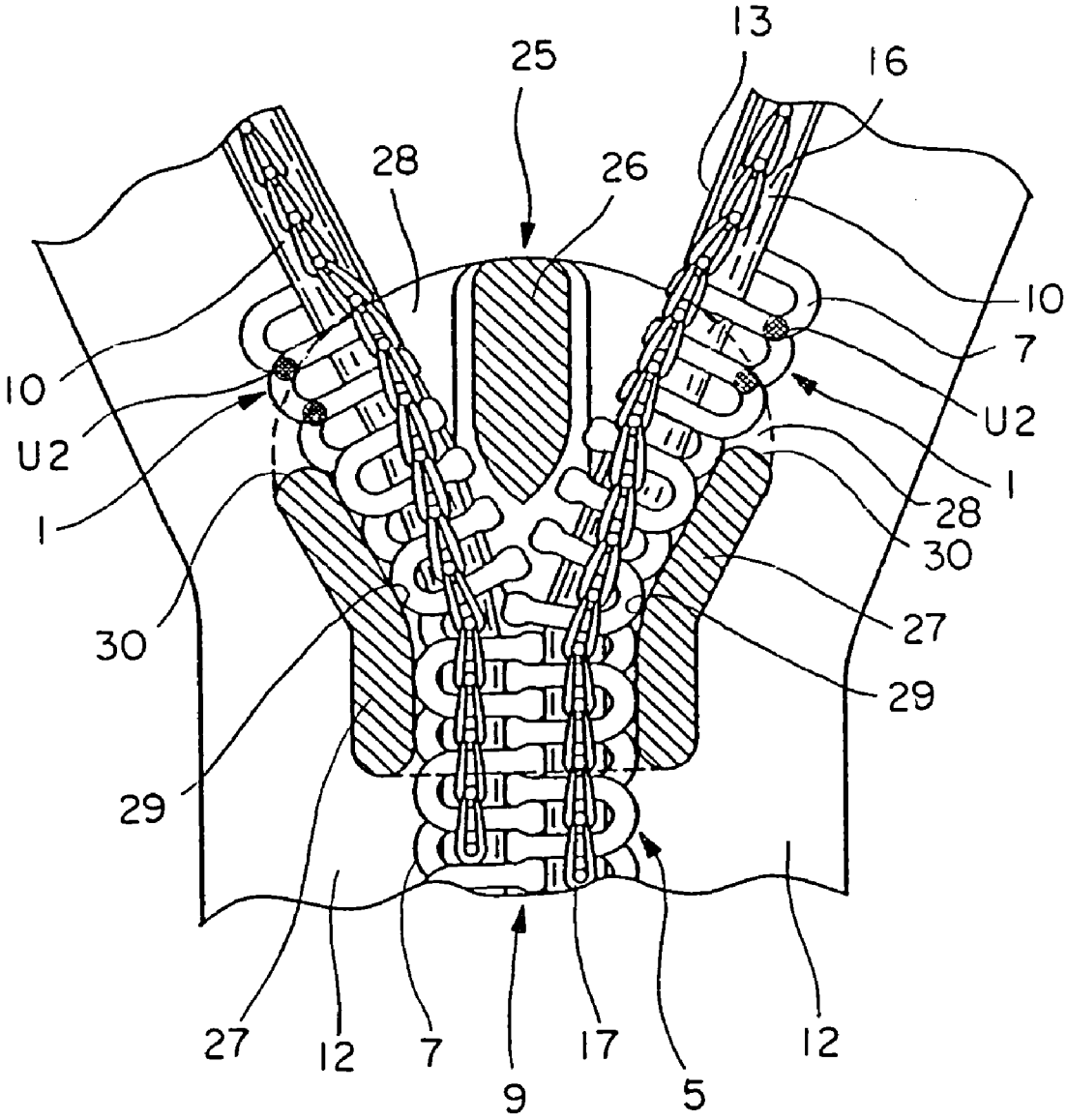
FIG. 3 is a sectional view showing major portions of a normal type linear slide fastener using zigzag-like fastener elements.
Figure 4:
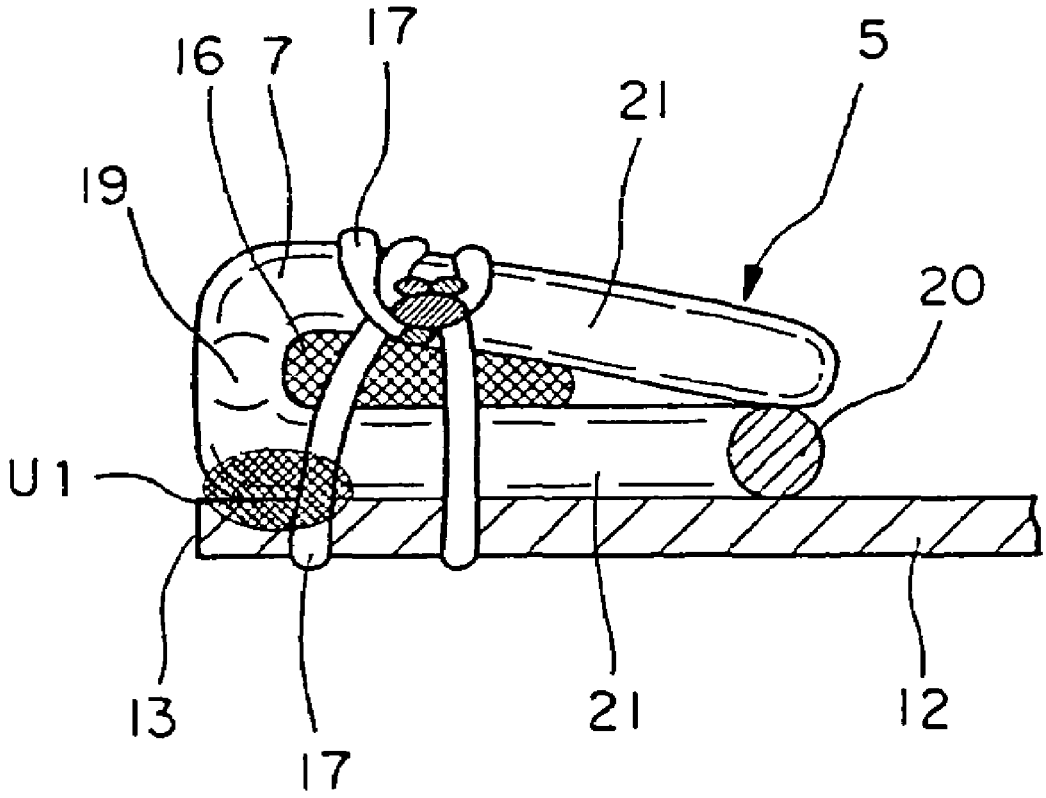
FIG. 4 is a sectional view of a top end stop of the same linear slide fastener.

For the top end stop of the linear slide fastener of the second embodiment of the invention shown in FIGS. 3 and 4, the zigzag-like fastener elements 7 are employed as the linear fastener element 5. In the same manner as in the first embodiment, the zigzag-like fastener elements 7 are sewed on the surface of the fastener tape 12 along the side edge 13 with the sewing thread 17. At this time, the zigzag-like fastener elements 7 are sewed over the core thread 16 with the sewing thread 17 such that the coupling heads 19 thereof project from the side edge 13 of the fastener tape 12 so as to form an endless fastener chain 9. The space portion 10 is produced at a specified interval in this fastener chain 9. By cutting the upper and lower leg portions 21 on the side of the inverted portion 20 in the zigzag-like fastener elements 7, the coupling heads 19 are pulled out from the core thread 16 and the sewing thread 17 so as to form the space portion 10. After the bottom end stop is created at one end of the space portion 10 and the top end stop 1 is created at the other end thereof, the fastener chain is cut out at the space portion 10 so as to produce a normal type slide fastener.

By moving plural coupling heads 19 of the zigzag-like fastener elements 7 adjacent to the space portion 10 formed in the fastener chain 9 to the inside of the fastener tape 12 from the side edge 13 of the fastener tape 12 such that the coupling heads 19 retreat, the coupling heads 19 are made to substantially coincide with the side edge 13. Then, the vicinity of the coupling head 19 of the zigzag-like fastener element 7, for example, the lower side thereof, which makes contact with the fastener tape 12, is fused $U_1$ by ultrasonic processing in a state in which the inverted portion 20 of the zigzag-like fastener elements 7 retreats from the core thread 16 and the sewing thread 17, and the zigzag-like fastener elements 7 are fixed to the fastener tape 12. Because the inverted portions 20 of the fixed zigzag-like fastener elements 7 project to the inside of the fastener tape 12 more inwardly compared to the other inverted portions 20 of the zigzag-like fastener elements 7, this portion functions as the top end stop 1.

When the slider 25 mounted on the fastener chain 9 slides toward the top end portion of the zigzag-like fastener elements 7 in order to make engagement of the zigzag-like fastener elements 7 with each other, as shown in FIG. 3, this top end stop 1 invades into the inside of the element passage 28 formed inside the slider 25 through the shoulder side of the slider 25. At this time, the coupling heads 19 at the top end stop 1 just oppose each other without coupling and the inverted portions 20 at the top end stop 1 come into contact with the inside wall faces 29 of the flange 27 provided on both sides of the element passage 28 protrudedly. Consequently, the top end stop 1 cannot move toward a rear mouth side of the slider 25 through the element passage 28, thereby stopping the sliding of the slider 25 easily. Further, by fusing $U_2$ together the upper and lower leg portions 21 on the side of the inverted portion 20 projected to the inside of the fastener tape 12 with loose spaces by ultrasonic processing, the top end stop 1 can be formed firmly.

Third Embodiment

Figure 5:
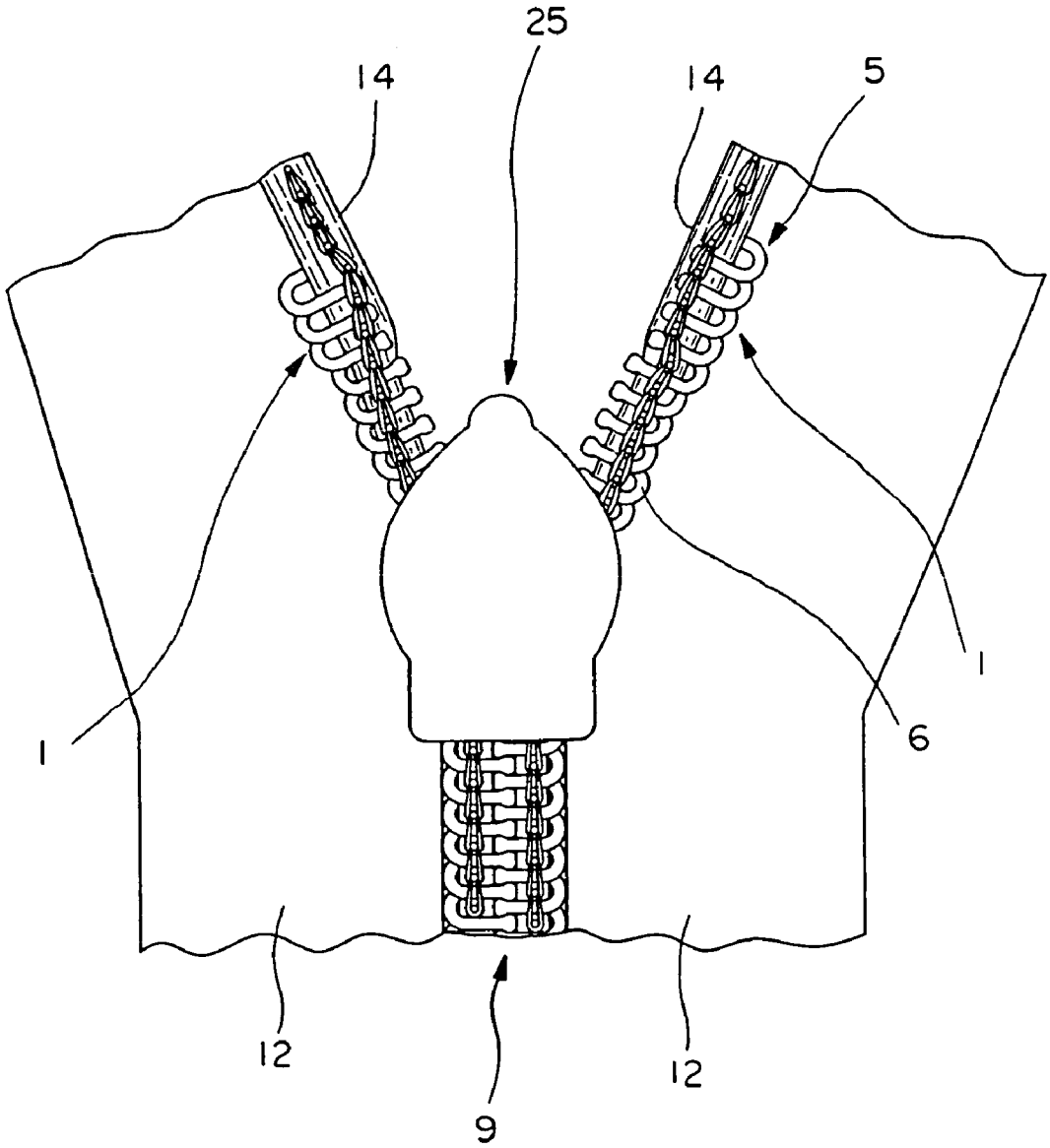
FIG. 5 is a rear view of a hidden type linear slide fastener using coil-like fastener elements.
Figure 7:
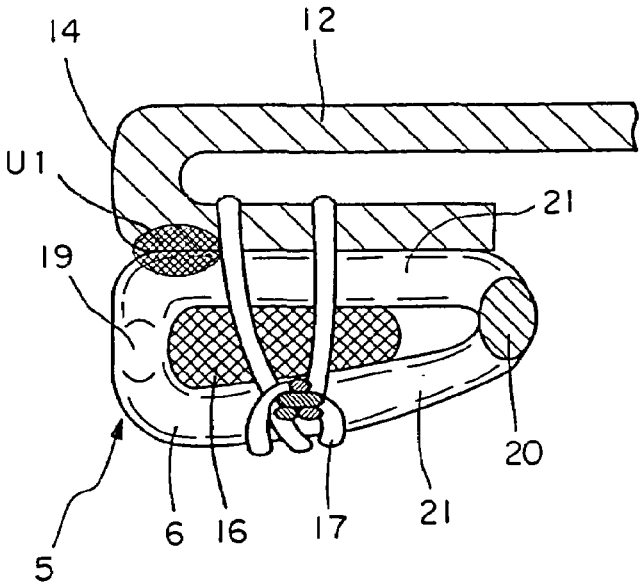
FIG. 7 is a sectional view of a top end stop of the same linear slide fastener.

For the top end stop of the linear slide fastener of the third embodiment shown in FIGS. 5 and 7, the coil-like fastener elements 6 are employed as the linear fastener element 5 and the coil-like fastener elements 6 are sewed on the surface of the fastener tape 12 along the bent side edge 14 with the sewing thread 17. At this time, the core thread 16 is passed through the inside of the coil-like fastener elements 6 and the coil-like fastener elements 6 are sewed over the core thread 16 with the sewing thread 17 such that the coupling heads 19 thereof project from the bent side edge 14 of the fastener tape 12 so as to form an endless hidden type fastener chain 9. The space portion 10 is produced at a specified interval in this fastener chain 9. By cutting the upper and lower leg portions 21 on the side of the inverted portion 20 in the coil-like fastener elements 6, the coupling heads 19 are pulled out from the core thread 16 and the sewing thread 17 so as to form the space portion 10. After the bottom end stop is created at one end of the space portion 10 and the top end stop 1 is created at the other end thereof, the fastener chain 9 is cut out at the space portion 10 so as to produce the hidden type slide fastener.

By moving the coil-like fastener elements 6 adjacent to the space portion 10 formed in the fastener chain 9 to the inside of the fastener tape 12 from the bent side edge 14 of the fastener tape 12 such that the coupling heads 19 retreat, the coupling heads 19 are made to substantially coincide with the bent side edge 14. Then, the lower side of the coupling head 19 in the coil-like fastener element 6, which makes contact with the fastener tape 12, is fused $U_1$ together with the fastener tape 12 by ultrasonic processing in a state in which the inverted portions 20 of the coil-like fastener elements 6 retreat from the core thread 16 and the sewing thread 17, and the coil-like fastener elements 6 are fixed to the fastener tape 12. Because the inverted portions 20 of the fixed coil-like fastener elements 6 project to the inside of the fastener tape 12 more inwardly compared to the other inverted portions 20 of the coil-like fastener elements 6, this portion functions as the top end stop 1.

Figure 6:
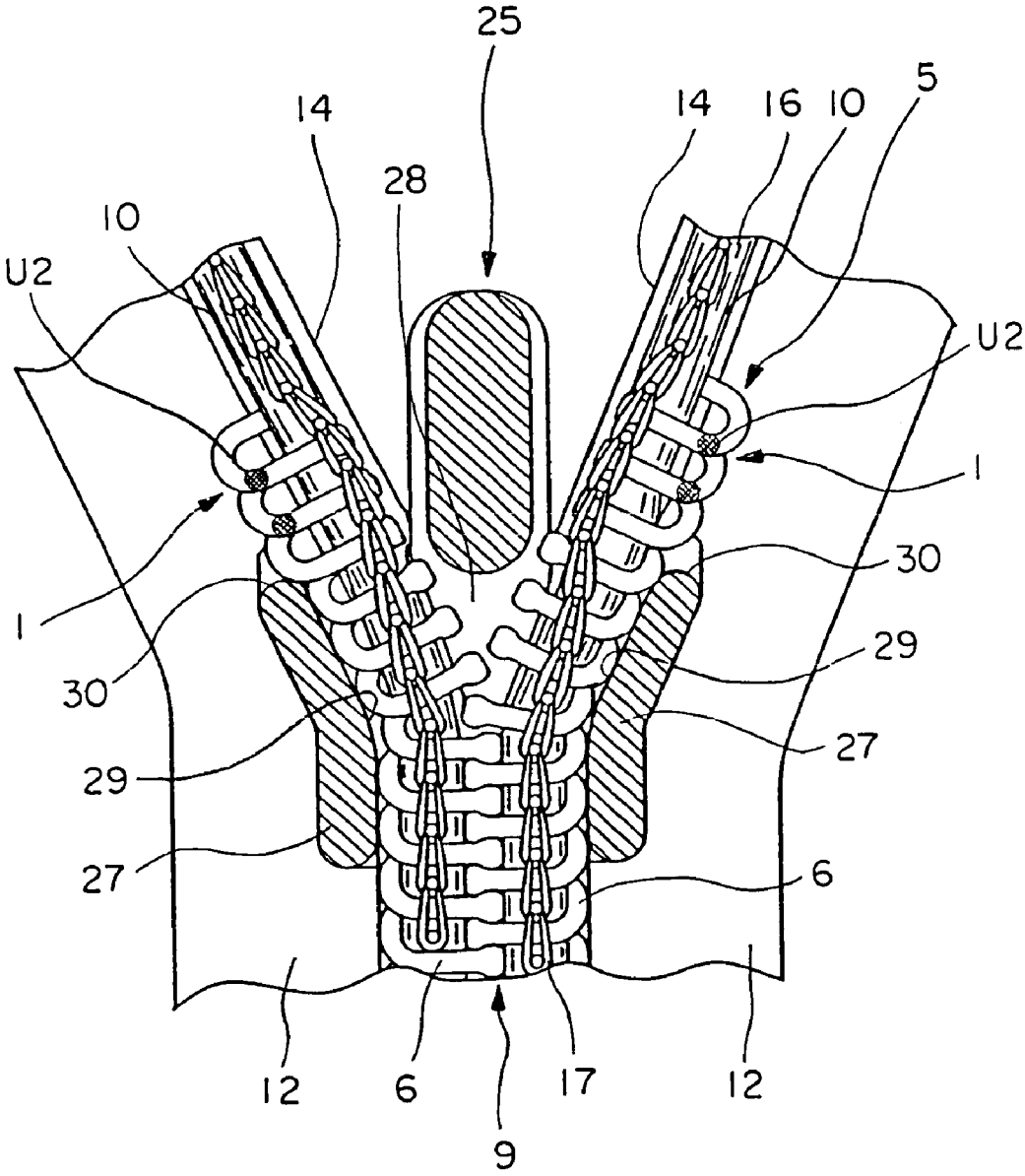
FIG. 6 is a sectional view showing major portions of the same linear slide fastener.

When the slider 25 mounted on the hidden type fastener chain 9 slides toward the top end portion of the coil-like fastener elements 6 in order to make engagement of the coil-like fastener elements 6 with each other, as shown in FIG. 6, the inverted portion 20 makes contact with the front end of the flange 27 of the slider 25 because the inverted portion 20 projects to the inside of the fastener tape 12. Consequently, the top end stop 1 cannot invade into the inside of the element passage 28 of the slider 25, thereby stopping the sliding of the slider 25. According to an alternative way, it is permissible to allow the top end stop 1 to invade into the inside of the element passage 28 formed inside the slider 25 through the shoulder side while keeping the coupling heads 19 at the top end stop 1 just opposing each other without coupling. At this time, the inverted portions 20 at the top end stop 1 come into contact with the inside wall faces 29 of the flange 27 provided on both sides of the element passage 28 protrudedly. Consequently, the top end stop 1 cannot move toward a rear mouth side of the slider 25 through the element passage 28, thereby stopping the sliding of the slider 25. Further, by fusing $U_2$ together the overlapping upper and lower leg portions 21 on the side of the inverted portion 20 projected to the inside of the fastener tape 12 with loose spaces by ultrasonic processing, the top end stop 1 can be formed firmly.

Fourth Embodiment

Figure 8:
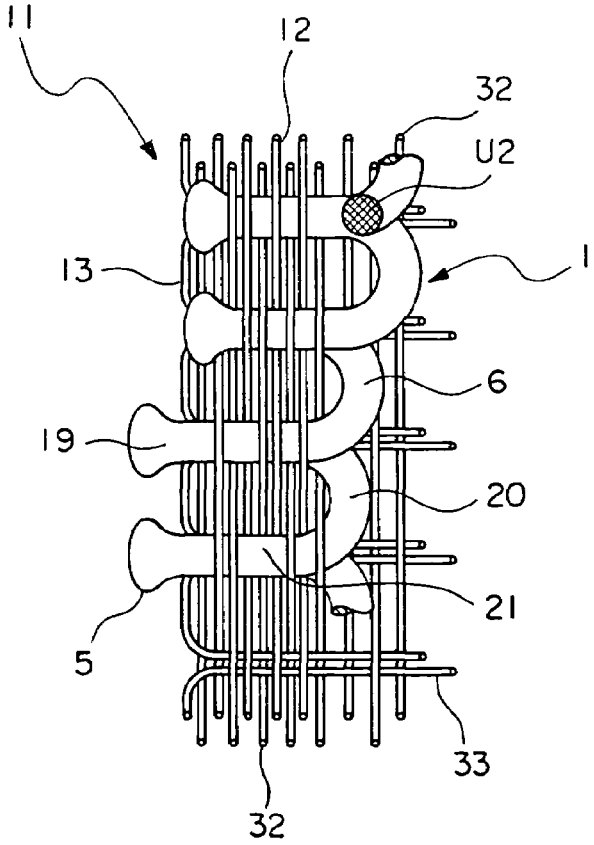
FIG. 8 is a front view showing major portions of a top end stop of a linear slide fastener in which coil-like fastener elements are woven.

For the top end stop 1 of the linear slide fastener according to the fourth embodiment of the invention shown in FIG. 8, the coil-like fastener elements 6 are used as the linear fastener element 5 and woven into the side end portion of the fastener tape 12 with a needle weaving machine. The coil-like fastener elements 6 are tightened with plural warp yarns 32 through the leg portions 21 and the side edge 13 of the fastener tape 12 is woven with weft yarns 33 of double pick while the coupling heads 19 of the coil-like fastener elements 6 project from the side edge.

In the fastener stringer woven in the above-described way, the upper and lower leg portions 21 exposed on the side of the coupling heads 19 of several elements in the coil-like fastener elements 6 are cut out at a predetermined interval and the elements 6 are pulled out from the warp yarns 32 through the inverted portion 20 so as to form the space portion 10, and then, the bottom end stop is created at one end of this space portion 10 and the top end stop 1 is created at the other end thereof. Plural pieces of the coupling heads 19 adjacent to the space portion 10 projecting from the side edge 13 of the fastener tape 12 are moved to the inside of the fastener tape 12, so that the side edge 13 substantially coincide with the front ends of the coupling heads 19 while the coupling heads 19 are kept in a non-coupling condition. Then, the leg portion 21 on the bottom portion of the coil-like fastener element 6 and the fastener tape 12 are fused $U_1$ together so as to prohibit the coupling heads 19 from coupling with other. The inverted portions 20 overlapping in the vertical direction of the coil-like fastener elements 6 projecting to the inside of the fastener tape 12 in this non-engaging portion are fused $U_2$ together depending on the case, in order to stop the sliding of the slider 25 by bringing the inverted portion 20 into a contact with the front end portion 30 of the flange 27 of the slider 25 or the inside wall face 29 of the flange 27.

Fifth Embodiment

Figure 9:
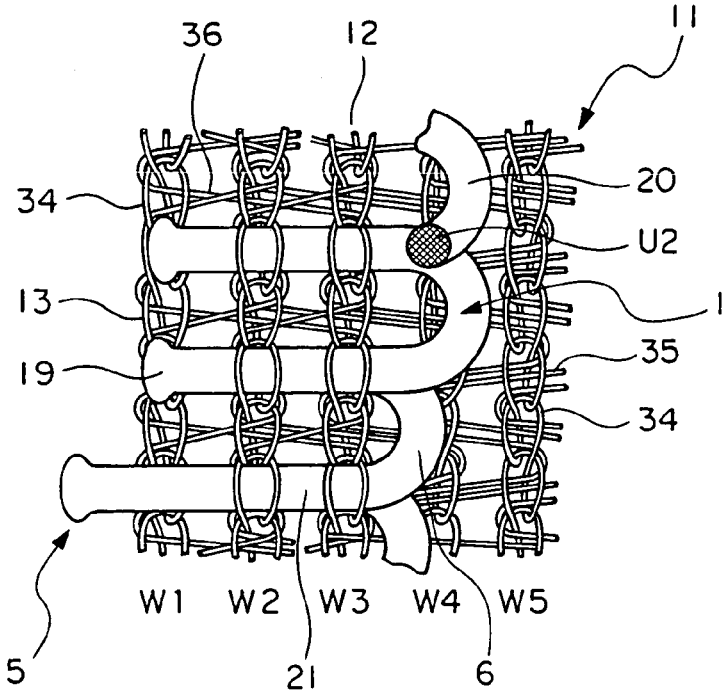
FIG. 9 is a front view showing major portions of a top end stop of a linear slide fastener in which coil-like fastener elements are knit.
Figure 10:
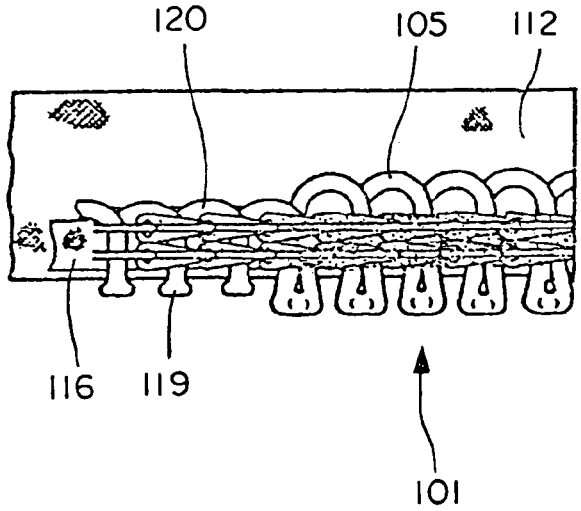
FIG. 10 PRIOR ART
FIG. 10 is a front view of a top end stop of a well known linear slide fastener.

For the top end stop 1 of the linear slide fastener according to the fifth embodiment of the invention shown in FIG. 9, the coil-like fastener elements 6 are used as the linear fastener element 5, and the coil-like fastener elements 6 are knit into the side edge portion of the fastener tape with a knitting machine. For the fastener tape 12, chain knitting yarns 34 of 1-0/0-1 and weft in-laid yarns 35 of 3-3/0-0 are disposed on all wales and entangled with each other, and for $W_1$ to $W_3$, weft in-laid yarns 36 of 0-0/2-2 are disposed and entangled with the weft in-laid yarns 35. To knit and fix the coil-like fastener elements 6, the leg portions 21 are captured and tightened with the chain knitting yarns 34 of $W_2$, $W_3$ such that the coupling heads 19 project from the chain knitting yarns 34 on the side edge 13, so as to knit a fastener stringer 11.

In the fastener stringer 11 knit in the above-described way, the upper and lower leg portions 21 exposed out on the side of the coupling heads 19 of some elements 6 in the coil-like fastener elements 6 are cut out at a predetermined interval and the elements 6 are pulled out from the chain knitting yarns 34 through the inverted portion 20 so as to form the space portion 10. The bottom end stop is created at one end of this space portion 10 and the top end stop 1 is created at the other end. By moving plural coupling heads 19 projecting from the side edge 13 and adjacent to the space portion 10 to the inside of the fastener tape 12, they are arranged such that the side edge 13 and the front ends of the coupling heads 19 substantially coincide with each other so as to form the non-coupling condition. The leg portion 21 on the bottom of the coil-like fastener elements 6 in this portion and the fastener tape 12 are fused $U_1$ together and fixed, thereby prohibiting the coupling heads 19 from coupling each other. The inverted portions 20 overlapping in the vertical direction of the coil-like fastener elements 6 projecting to the inside of the fastener tape 12 in this non-engaging portion are fused $U_2$ together depending on the case, in order to stop the sliding of the slider 25 by bringing the inverted portion 20 into a contact with the front end portion 30 of the flange 27 of the slider 25 or the inside wall face 29 of the flange 27.

INDUSTRIAL APPLICABILITY

As for the application field, the normal type and the hidden type linear slide fastener having the top end stop are applicable as slide fasteners used in an overlapping portion of various kinds of clothes, for example, shirts, sport shirts, sport wears, shirt waist blouses, and jackets. Because the top end stop includes plasticity without any burr on its surface, there is no fear that the skin may be damaged even if it contacts the neck or the like, and further, its tactile feeling is excellent thereby providing no discomfort feeling.

What is claimed is:

1. A top end stop of a linear slide fastener, wherein linear fastener element rows are attached to side edges of fastener tapes or bent side edges bent in parallel along the side edges, each of the linear fastener element rows comprises plural linear fastener elements, each of the liner fastener elements comprises a coupling head and an inverted portion connecting adjacent linear fastener elements to each other, wherein the inverted portion of at least one linear fastener element at a top end portion of each linear fastener element row is projected to an inside of each of the fastener tapes more inwardly compared to a position of the inverted portions of the other linear fastener elements, the coupling head is placed along the side edge of each fastener tape or the bent side edge bent in parallel along the side edge, and each linear fastener element and each fastener tape are fused together and fixed, wherein said at least one linear fastener element at the top end portion of each linear fastener element row is entirely placed on the inside of each fastener tape, and wherein each of the linear fastener elements other than said at least one fastener element at the top end portion of each linear fastener element row comprises the coupling head projecting from the side edge or the bent side edge, wherein right and left linear fastener elements fused together and fixed on the fastener tapes comprise a stop mechanism by bringing right and left inverted portions into contact with inside wall faces of flanges on a shoulder side of a slider while respective opposing coupling heads are in a non-coupling condition so as to form the top end stop.

2. The top end stop of the linear slide fastener according to claim 1, wherein each linear fastener element which is placed, fused together and fixed on each fastener tape makes contact with the slider so as to stop the slider.

3. The top end stop of the linear slide fastener according to claim 1, wherein coil fastener elements are used as the liner fastener elements, and the coil fastener elements are attached to a surface of the side edge of each fastener tape.

4. The top end stop of the linear slide fastener according to claim 1, wherein zigzag fastener elements are used as the linear fastener elements, and the zigzag fastener elements are attached to a surface of the side edge of each fastener tape.

5. The top end stop of the linear slide fastener according to claim 1, wherein coil fastener elements are used as the linear fastener elements, and the coil fastener elements are sewed on the bent side edge of each fastener tape bent into a form of a letter U along the side edge.

6. The top end stop of the linear slide fastener according to claim 1, wherein a core thread is passed through the linear fastener elements and the linear fastener elements are sewed onto each fastener tape.

7. The top end stop of the linear slide fastener according to claim 1, wherein vicinity of the coupling head of each linear fastener element and each fastener tape are fused together and fixed through a contact portion.

8. The top end stop of the linear slide fastener according to claim 1, wherein upper and lower leg portions on a side of the inverted portion of each linear fastener element are fused and fixed to each other.

9. The top end stop of the linear slide fastener according to claim 1, wherein a front end of the coupling head of the placed linear fastener element substantially coincides with the side edge or the bent side edge.

* * * * *